United States Patent [19]

Pouchot

[11] Patent Number: 5,033,507

[45] Date of Patent: Jul. 23, 1991

[54] FILTER COVER ASSEMBLY FOR A RESPIRATOR

[75] Inventor: Thomas D. Pouchot, Gibsonia, Pa.

[73] Assignee: Mine Safety Appliances Company, Pittsburgh, Pa.

[21] Appl. No.: 540,364

[22] Filed: Jun. 19, 1990

[51] Int. Cl.[5] ..... A62B 7/10; A62B 23/02

[52] U.S. Cl. ..... 137/550; 128/206.17; 128/206.15; 128/205.29

[58] Field of Search ..... 137/550, 854; 128/205.29, 206.12, 206.15, 206.17

[56] References Cited

U.S. PATENT DOCUMENTS

| | | | |
|---|---|---|---|
| 3,059,637 | 10/1962 | Senne | 137/854 X |
| 3,990,439 | 11/1976 | Klinger | 137/854 X |
| 4,543,112 | 9/1985 | Ackley et al. | 128/206.15 X |
| 4,548,626 | 10/1985 | Ackley et al. | 128/206.17 X |
| 4,686,976 | 8/1987 | Bakkila et al. | 128/206.15 |
| 4,793,342 | 12/1988 | Haber et al. | 128/206.17 X |
| 4,818,122 | 4/1989 | Arbuthnot | 383/10 |
| 4,838,262 | 6/1989 | Katz | 137/854 X |
| 4,850,346 | 7/1989 | Michel et al. | 128/206.15 X |

*Primary Examiner*—John Rivell

*Attorney, Agent, or Firm*—Reed Smith Shaw & McClay

[57] ABSTRACT

The present invention provides a filter cover assembly for use with the filter of a respirator. The semi-rigid filter cover assembly fits snugly over the face of the filter and, with the use of a one-way valve assembly mounted therein, allows the user to continue using the respirator while at the same time containing any contaminated particulate matter that may fall out of the filter. This permits the user to continue using the respirator while in a decontamination zone without danger of dispersing contaminated matter. It also permits easy handling and storage of the filter between uses without necessitating the cleaning of the filter.

10 Claims, 1 Drawing Sheet

FILTER COVER ASSEMBLY FOR A RESPIRATOR

FIELD OF THE INVENTION

The present invention relates to a filter cover assembly for a respirator and more particularly to a filter cover assembly that can be put in place very easily as the user of the respirator is leaving a contaminated environment and that is capable of containing any contaminant that falls out of the filter, thereby preventing contamination of the clean-up or decontamination area.

BACKGROUND OF THE INVENTION

In situations where work is being performed in a contaminated environment by workers wearing respirators, they typically exit the contaminated area by passing through one or a series of clean-up areas or decontamination zones. Often the workers continue to wear their respirators in the clean-up areas. This practice, however, presents the risk that contaminated matter, drawn into the filter of the respirator during use, may fall out of the filter in the clean-up area, or even in the clean environment beyond the clean-up area. To avoid this problem, the user of the respirator would sometimes plug up or tape up the filter to prevent contaminants from falling out. In doing this, however, the user blocked the air flow through the filter so that he could no longer use the respirator. As a result, the user would have to remove the respirator at an earlier point in the decontamination process than would otherwise be desirable. Alternatively, the user would, after plugging up the filter, have to hold his breath, until he was sufficiently decontaminated to safely remove the respirator.

U.S. Pat. No. 4,818,122 discloses an accessory device into which is placed the entire filter unit of a respirator so as to permit the user to continue using the respirator while showering. It is primarily designed to keep the filter dry. It consists of a relatively large, flat, triangular-shaped bag made from a waterproof and flexible material. The bag is placed entirely over the filter through a zip-type closure along the entire length of one of the sides of the triangle which is opened to allow placement of the bag therein and then closed to seal the bag around the filter unit with the face mask hose exiting therefrom. Continued use of the respirator is accommodated through a one-way valve located in the side of the bag which allows the in-flow of air to the filter.

One disadvantage of this device is that it cannot be quickly and easily installed since the triangular bag must be carefully positioned so as to align the one-way valve in the bag with the filter inlet of the respirator to prevent the flexible bag from being sucked against the filter. Moreover, even if properly aligned initially, there exists the possibility that the filter inlet and the one-way valve may subsequently become misaligned and cause breathing difficulty for the user.

Another disadvantage of this device is that it is prone to puncture and other damage. Also, it is difficult to clean the device between uses, requiring someone to either reach inside or turn the bag inside out to clean the contaminated matter from the creases along the edges of the triangular bag. Still another disadvantage is that the bag is quite large and bulky since it must accommodate an entire filter unit. Finally, it is questionable whether the zip-type closure cam provide a seal adequate to prevent small diameter particulate matter from passing out of the bag, especially around the location where the face mask hose exits the bag.

It would be desirable, therefore, to provide a small, durable, easy to use, positively sealing device for containing the contaminated matter that falls out of the respirator filter, while at the same time allowing the respirator to continue functioning as the user passes through the various decontamination zones and clean-up areas. Such a device would also allow the respirator to be handled, stored and transported in a clean environment without the necessity of decontaminating it after each use.

SUMMARY OF THE INVENTION

Generally, the present invention relates to a filter cover assembly for a respirator that when placed over a respirator filter, allows air to flow through the filter, so that use of the respirator can be continued, while at the same time keeping the filter dry and containing any contaminated particulate matter which might be dislodged from the filter. The filter cover assembly of the present invention consists of a cover housing which is preferably formed from a material which is semi-rigid, lightweight, non-brittle and non-corrosive such as rubber or plastic. The cover housing is very durable and is not prone to puncture and other damage. The cover housing is designed to fit snugly over the inlet face of the filter and preferably is round in shape, although it can be made in any shape which corresponds to the shape of the filter over which it fits. The cover housing comprises a front face, a side wall, a knuckle and an outer flange. Disposed in the front face of the cover housing is a valve assembly comprising a valve cover and a one-way valve, preferably made of plastic.

When the respirator user exits a contaminated environment, he quickly and easily places the filter cover assembly over the inlet face of the respirator filter so as to provide an airtight and watertight seal between the side of the filter and the outer flange of the cover housing. This seal is provided by a pressure fit between the outer flange of the cover housing and the side of the filter and assures that any air drawn into the respirator will come through the one-way valve disposed in the front face of the cover housing. This design also assures that no contaminated particulate matter from the filter can escape through the cover housing. Air is allowed to flow into the filter through the one-way valve while simultaneously, any contaminated matter falling out of the filter is trapped within the packet formed by the front face and side wall of the cover housing and the front surface of the filter since it cannot pass out through the one-way valve. Also, the cover prevents water from being drawn into the filter. This arrangement allows the user to continue to use the respirator while he is in a cleanup area while at the same time preventing contamination of the clean-up area with the contaminated contents of the filter. It further allows the filter to be handled, stored and transported easily in a clean environment without the need for decontaminating it after every use.

The present invention, due to its design, is automatically positioned with the filter directly aligned with the one-way valve, whenever it is used. Thus, not only is initial placement of the filter cover assembly very easy, but continued alignment of the filter with the one-way valve is assured. The compactness of the filter cover assembly is a distinct advantage in terms of handling and storage. It is also extremely easy to clean between uses because the interior of the cover assembly is easily accessible.

Other details, objects and advantages of the present invention will become apparent as the following description of a presently preferred embodiment of practicing the invention proceeds.

BRIEF DESCRIPTION OF THE DRAWING

In the accompanying drawing, a preferred embodiment of the present invention is illustrated, by way of example only, wherein.

DESCRIPTION OF THE PREFERRED EMBODIMENT

Figure 1:
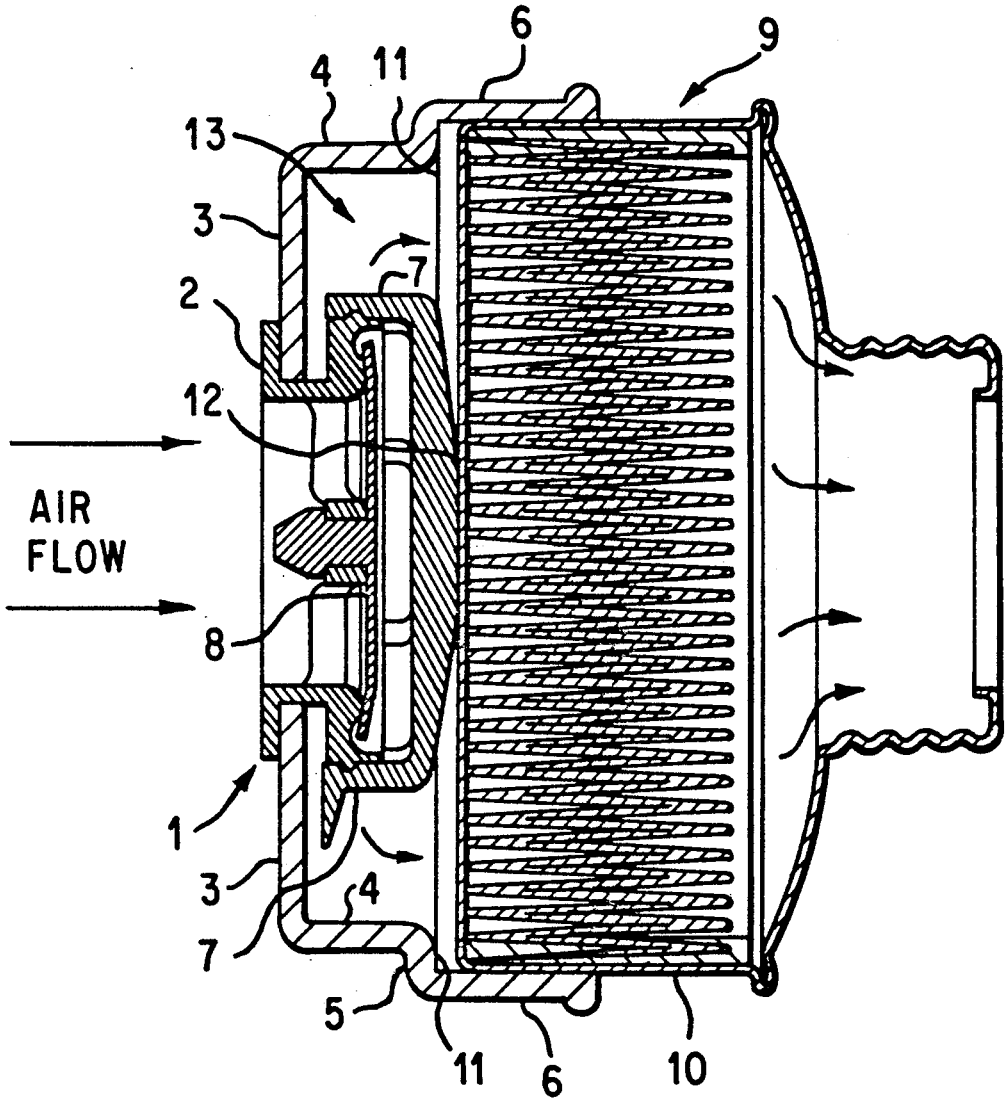
FIG. 1 is a sectional diagram of the filter cover assembly of the present invention.

As shown in FIG. 1, a filter cover assembly comprises a cover housing 1 and a valve assembly 2. The cover housing 1 comprises a front face 3, a side wall 4, a knuckle 5 and an outer flange 6. The knuckle 5 is located between the side wall 4 and the outer flange 6 so that the side wall 4 and the outer flange 6 are substantially parallel to each other but offset from one another. The valve assembly 2 preferably comprises a valve cover 7 and a one-way valve 8, such as a flapper valve.

The cover housing 1 is preferably formed from a semi-rigid, lightweight, non-brittle, non-corrosive material such as rubber or plastic. The inside dimensions of the outer flange 6 are such that the cover housing 1 can be snugly slipped over a respirator filter 9 and can maintain its position due to friction between the outer surface of the wall 10 of the filter 9 and the inner surface of the outer flange 6.

The depth of the side wall 4 is preferably the same as the depth of the valve assembly 2 so that when the outer flange 6 is slipped over the filter 9 and pushed thereagainst until the knuckle 5 contacts the front edge 11 of the filter 9, the valve cover 7 is just in contact with the front surface 12 of the filter 9.

The air-tight seals formed between the outer flange 6 and the wall 10 of the filter 9 and between the knuckle 5 and the front edge 11 of the filter 9 also prevent contaminated particulate matter which has become dislodged from the filter 9 from passing to the external environment from the pocket 13 defined by the front surface 12 of the filter 9 and the side wall 4 and front face 3 of the cover housing 1. These seals also insure that the only air passing from the external environment into the filter 9 will pass through the valve assembly 2. This design also prevents water from entering the filter 9, thereby keeping it dry during showering in the decontamination area.

The valve assembly 2, preferably located in the center of the front face 3 of the cover housing 1, allows air from the external environment to be drawn into the filter 9, but does not allow contaminated particulate matter that has become dislodged from the filter 9 and fallen into the pocket 13 to pass through the one-way valve 8 and into the external environment. The valve cover 7 keeps the movement of the one-way valve 8 from being restricted by the front surface 12 of the filter 9.

Before leaving a contaminated environment, a respirator user quickly and easily places the filter cover assembly 1 over the filter 9 of his respirator. The filter cover assembly 1 allows the user to continue to breath through his respirator as he passes through a decontamination zone and into a clean environment. At the same time the pocket 13 formed within the filter cover assembly 1 contains any contaminated particulate matter that is dislodged from the filter 9 and keeps such contaminated matter from entering the outside environment.

While a presently preferred embodiment of practicing the invention has been shown and described with particularity in connection with the accompanying drawing, the invention may otherwise be embodied within the scope of the following claims.

What is claimed is:

1. A removable filter cover assembly for use with a respirator including a filter having a construction lacing means for preventing matter dislodged from a filter inlet face of filter from passing to the external environment, the assembly comprising:
   - a semi-rigid cover housing including a front face;
   - an outer flange dimensioned for air-tight, friction-fit placement over a wall of the filter to form an air-tight seal therewith;
   - means for connecting the front face and the outer flange and for spacing the front face from the filter inlet face; and
   - a one-way valve assembly supported in the dover housing for permitting continued use of the respirator and for preventing any matter dislodged from the filter from passing to the external environment while the filter cover assembly is placed over the wall of the filter.

2. A filter cover assembly as described in claim 1 wherein the cover housing is made of a lightweight material.

3. A filter cover assembly as described in claim 1 wherein the cover housing is made of a non-brittle material.

4. A filter cover assembly as described in claim 1 wherein the cover housing is made of a non-corrosive material.

5. A filter cover assembly as described in claim 1 wherein the one-way valve assembly includes a valve cover.

6. A filter cover assembly as described in claim 5 wherein the one-way valve assembly is located in the front face of the cover housing.

7. A filter cover assembly as described in claim 1 wherein the means for connecting the front face and the outer flange and for spacing the front face from the filter inlet face comprise a side wall continuously joined to the front face and to a knuckle, the knuckle being continuously joined to the outer flange, wherein the side wall extends substantially parallel to but inwardly offset from the outer flange such that the knuckle is positionable adjacent the filter inlet face to establish a predetermined placement position of the cover housing on the filter.

8. A filter cover assembly as described in claim 7 wherein the one-way valve assembly includes a valve cover.

9. A filter cover assembly as described in claim 8 wherein the valve cover is in close proximity to the filter inlet face when the knuckle is adjacent the filter inlet face.

10. A filter cover assembly as described in claim 9 wherein the filter, the side wall, the front face and the valve assembly form a pocket which contains any particles which may be dislodged from the filter.

* * * * *

UNITED STATES PATENT AND TRADEMARK OFFICE

CERTIFICATE OF CORRECTION

PATENT NO. : 5,033,507

DATED : July 23, 1991

INVENTOR(S) : Thomas D. Pouchot

It is certified that error appears in the above—identified patent and that said Letters Patent is hereby corrected as shown below:

In Column 1, line 67, the term "cam" should be --can--.

In Claim 1, Column 4, line 13, the term "lacing" should be --lacking--.

In Claim 1, Column 4, line 15, the term "the" should be inserted after --of--.

In Claim 1, Column 4, line 24, the term "dover" should be --cover--.

Signed and Sealed this

Fifteenth Day of December, 1992

*Attest:*

DOUGLAS B. COMER

*Attesting Officer*

*Acting Commissioner of Patents and Trademarks*